US006729520B2

(12) United States Patent
Gilbert

(10) Patent No.: US 6,729,520 B2
(45) Date of Patent: May 4, 2004

(54) MECHANICS TOOL CHEST ORGANIZER

(76) Inventor: Jeffrey Gilbert, 35166 Glengary Cir., Farmington Hills, MI (US) 48331

( * ) Notice: Subject to any disclaimer, the term of this patent is extended or adjusted under 35 U.S.C. 154(b) by 73 days.

(21) Appl. No.: 10/083,958

(22) Filed: Feb. 27, 2002

(65) Prior Publication Data

US 2002/0145025 A1 Oct. 10, 2002

Related U.S. Application Data

(60) Provisional application No. 60/271,918, filed on Feb. 27, 2001.

(51) Int. Cl.[7] ..... A45F 3/14; A45C 13/30; A63B 55/00

(52) U.S. Cl. ..... 224/625; 224/219; 224/600

(58) Field of Search ..... 224/904, 600, 224/610, 625, 623, 586, 219; 2/48, 51

(56) References Cited

U.S. PATENT DOCUMENTS

| | | | | | |
|---|---|---|---|---|---|
| 2,066,072 | A | | 12/1936 | Powell | |
| 2,265,690 | A | | 12/1941 | Fiedler | |
| 2,423,002 | A | * | 6/1947 | Bray | 2/52 |
| 2,538,677 | A | | 1/1951 | Ferrand | |
| 2,717,391 | A | | 9/1955 | Bracken | |
| 2,853,709 | A | * | 9/1958 | Peterson et al. | 2/51 |
| 3,115,639 | A | | 12/1963 | Moszczynski | |
| 3,541,976 | A | * | 11/1970 | Rozas | 108/43 |
| 4,037,272 | A | * | 7/1977 | Shani | 2/48 |
| 4,106,121 | A | | 8/1978 | Belson | 2/102 |
| 4,369,526 | A | | 1/1983 | Clutts | 2/51 |
| 4,826,059 | A | | 5/1989 | Bosch et al. | 224/183 |
| 4,874,119 | A | * | 10/1989 | Winter | 224/610 |
| 4,953,765 | A | * | 9/1990 | Little et al. | 224/583 |
| 5,056,661 | A | * | 10/1991 | Balzano | 206/372 |
| 5,107,545 | A | | 4/1992 | Potter | 2/46 |
| 5,337,933 | A | * | 8/1994 | Nunez | 224/904 |
| 5,505,356 | A | * | 4/1996 | Noriega et al. | 224/250 |
| 5,517,696 | A | | 5/1996 | Krugler | 2/250 |
| 5,526,535 | A | | 6/1996 | Dobrzenski | 2/102 |
| 5,829,056 | A | * | 11/1998 | Hubert | 2/48 |
| 5,927,574 | A | * | 7/1999 | Ruesink | 224/149 |
| 6,267,277 | B1 | * | 7/2001 | Taylor | 224/183 |
| 6,332,220 | B1 | * | 12/2001 | Mai | 2/51 |

* cited by examiner

*Primary Examiner*—Sue A. Weaver
(74) *Attorney, Agent, or Firm*—Gifford, Krass, Groh, Sprinkle, Anderson & Citkowski, P.C.

(57) ABSTRACT

A tool chest organizer having detachable pockets variously arrangeable for a particular set of tools required by a user. An optional clear cover is attachable to the organizer. An attachable shelf unit provides a work space and has fasteners for securing tools.

12 Claims, 4 Drawing Sheets

FIG - 1
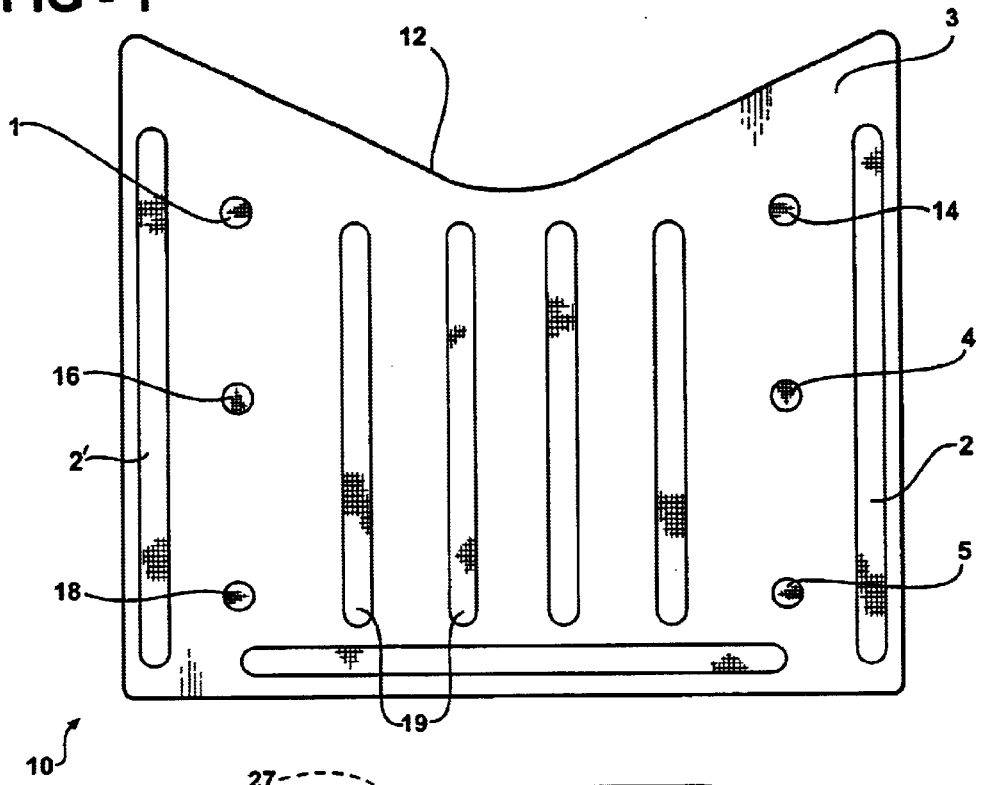
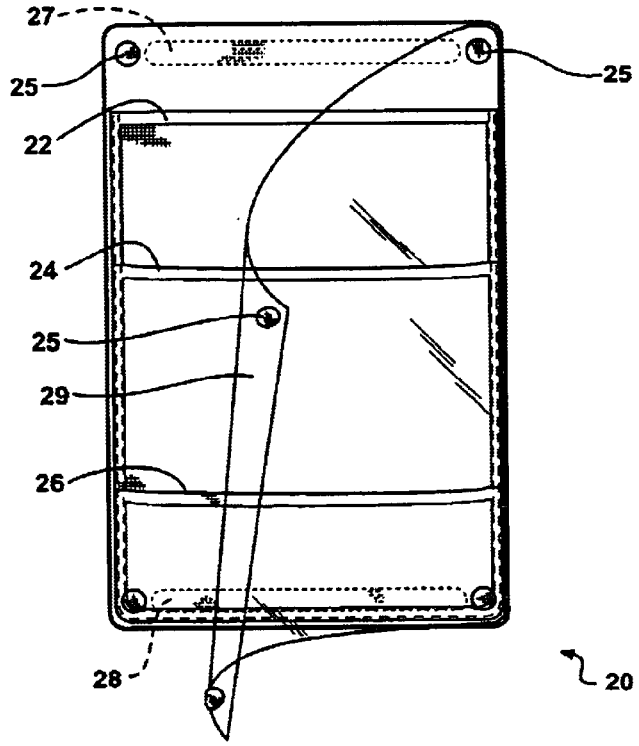
FIG - 2

MECHANICS TOOL CHEST ORGANIZER

RELATED APPLICATION

This application claims priority of U.S. Provisional Patent Application No. 60/271,918 filed Feb. 27, 2001 and is incorporated herein by reference.

FIELD OF THE INVENTION

The present invention relates to the field of tool belts generally and, particularly, to the field of tool belts for mechanics while lying in the supine position, and still more particularly to the field of tool belts in the aviation industry.

DESCRIPTION OF THE PRIOR ART

Mechanics and technicians, specifically in the aviation arena, must perform maintenance while lying in the supine position. Numerous tools are required to perform tasks associated with the removal and installation of equipment and specific testing functions. It is also a requirement to maintain tool control to prevent the incidence of foreign object damage from lost tooling. Numerous aviation accidents have resulted from the lack of tool control. These tools also need to be readily accessible and located within convenient reach because of the sometimes-difficult locations and confined spaces mechanics work in. While technicians currently utilize tote trays and tool bags, these are usually located out of reach, and recognition of the tool is difficult. They also do not provide tool control in the event of accidental spillage. Current tool belts do not have closures to prevent the loss of tools, and are not designed for the specific type of tools required in the aviation field. The current tool belts cannot be modified for the specific job requirements encountered in the aviation field.

Thus, there remains a need for positive tool control to prevent foreign object damage, visual identification, and ease of access to tooling and test equipment while performing maintenance functions and tasks specifically while in the supine position. A need also exists to maintain the equipment within close proximity to the technician, while maintaining a comfortable and safe working environment.

SUMMARY OF THE INVENTION

A tool chest organizer is described including a main unit having a skin compatible surface and an opposing surface. An inventive tool organizer also includes a first plurality of hook and loop fastener strips attached to the opposing surface, a plurality of snap fastener portions attached to the opposing surface and a detachable pocket having a hook and loop fastener strip complementary to one of said first plurality of hook and loop fastener strips attached to the opposing surface. A tool organizer incorporates a neck strap adjustably attached to said main unit, a waist strap adjustably attached to said main unit, an attachable shelf unit having a snap fastener component and a plurality of hook and loop fastener strips on a work surface thereof, said shelf unit attached horizontally to said main unit by a complementary hook and loop fastener strip to one of said first plurality of hook and loop fastener strips on the opposing surface of said main unit and a support strap securing the snap fastener component of said shelf unit to said main unit.

Optionally, an inventive organizer has the feature of an attachable translucent cover, said cover attached to said main unit by a complementary hook and loop fastener strip to one of said first plurality of hook and loop fastener strips on the opposing surface of said main unit. An inventive tool organizer further optionally includes an adjustable buckle for adjustment of the support strap. Where desirable, a reflective material may be attached to the main unit. In a further option, a detachable pocket used in an inventive organizer may contain a stretch material outer panel and may further include at least two preformed compartments.

In an embodiment of the present invention, a tool chest organizer includes a main unit having a skin compatible surface and an opposing surface, a first plurality of hook and loop fastener strips attached to the opposing surface and a plurality of snap fastener portions attached to the opposing surface. An inventive organizer also has the feature of a detachable pocket having a hook and loop fastener strip complementary to one of said first plurality of hook and loop fastener strips attached to the opposing surface, a neck strap adjustably attached to said main unit and a waist strap adjustably attached to said main unit. An organizer incorporates a hinged attachable shelf unit having an attachment face, a work surface, a snap fastener component and a plurality of hook and loop fastener strips, the fastener strips on the attachment face and on the work surface thereof, said shelf unit attached horizontally to said main unit by a complementary hook and loop fastener strip to one of said first plurality of hook and loop fastener strips on the opposing surface of said main unit and a support strap securing the snap fastener component of said shelf unit to said main unit.

BRIEF DESCRIPTION OF THE DRAWINGS

FIG. 1 is a front top view of the main component of an embodiment of the present invention that attaches to the chest area providing attachment points for the removable shelf and pouches.

FIG. 2 is a front partial cutaway view of a pouch design according to the present invention that contains different depth pockets. The pouch has strips on the aft side for attachment to a main unit.

FIG. 3C is a front view of the pouch containing several pockets utilizing stretch fabric.

FIG. 4A is a front view of an attachable shelf according to the present

FIG. 5 is a front view of the pouch with socket strips sewn in.

DETAILED DESCRIPTION OF THE INVENTION

Figure 3A:
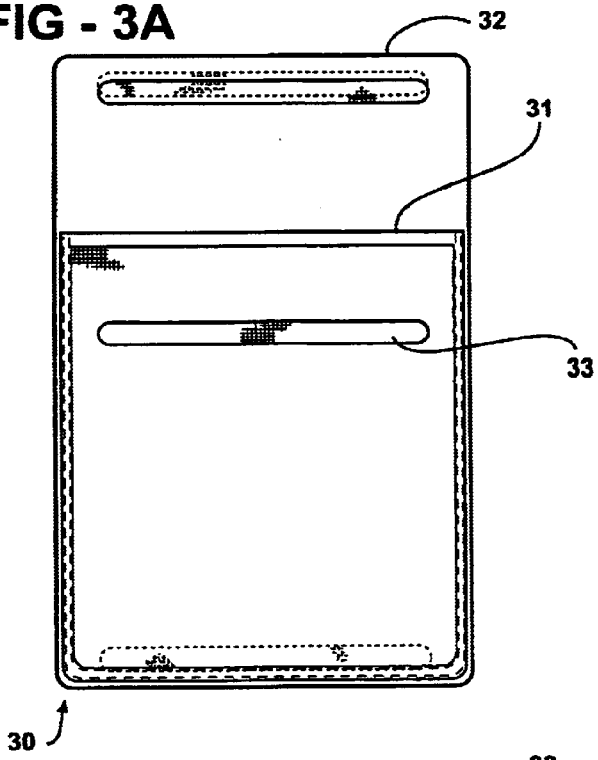
FIGS. 3A, 3B and 3C are front views of three pouches according to the present invention. The pouch of FIG. 3A has one pocket for universal use. The pouch of FIG. 3B is adapted to receive a digital multimeter with two separate pockets for the multimeter probes.

The present invention allows for interchangeability of the tool carrier since different size tools and test equipment are required related to the job. This is accomplished herein with the use of selectively attachable pouches and organizers designed to accommodate various tools and test equipment.

The present invention also provides a work area while in the standing position. This is in the form of a detachable shelf that is mounted to the front of the unit to provide an area to place objects while freeing up both hands. This allows the technician to perform various tasks by keeping the test equipment within visual contact, while using both hands to perform the task, thereby preventing the test equipment from falling and/or damaging sensitive equipment.

The present invention provides visible recognition of the tools through the use of removable clear vinyl covers. This allows the technician to see a tool or test equipment being utilized. This also provides additional safety by preventing a conductive tool or test equipment from becoming a hindrance by making contact with structure or wiring.

The present invention fulfills this need by providing the mechanic or technician with a tool bib, which effectively organizes the tools and test equipment, providing safe and efficient access while in the supine position.

The main unit includes several material types. The inner panel is preferably a soft material such as neoprene for added comfort. The middle panel is a harder material that is still flexible, such as a thin sheet of plastic. The outer panel is preferably made of a non-absorbent type of material such as CORDURA®. The outer panel would also contain hook-loop fastener strips for the attachment of pouches and/or pockets. The strips are located on the entire front outer panel section, allowing for varied placement of equipment pouches and the attachment of the removable shelf. The unit would contain fasteners midpoint for the attachment of the shelf straps. The main unit has webbing for the waist and neck straps, preferably with an inner panel or moisture absorbent material at the skin contact points. Optionally, adjustable buckles or hook-loop fasteners are provided for size adjustment. If buckles are utilized for adjustment, then preferably fasteners are used for attachment of the neck and waist straps at the applicable locations.

A folding detachable shelf according to the present invention is made of non-absorbent material on both the inner and outer panels. The middle panel is preferably made of a hard plastic for support of the equipment. The shelf also contains hook-loop fastener strips for the attachment of various equipment pouches. The bottom of the shelf preferably has a hook-loop fastener strip for attachment to the main unit. Additional fasteners are optionally provided for attachment of the web straps. These web straps would also have adjustable buckles for adjustment of the angle of the shelf relative to body position. The straps are optionally removed to facilitate the folding of the shelf closed for storage or as added tool protection. The outside of the unit could also contain reflective type material for night protection.

The pouches are preferably made of a non-absorbent material on the inner and outer panels. The inner panels would contain hook-loop fastener strips for attaching to the main unit. The outer panels optionally have thin hook-loop fastener strips at the top and midpoint for attachment of the clear plastic flaps, thereby allowing the flaps to be selectively removed. The pouch size according to the present invention is varied in length, width and height due to the difference in the size of tools and test equipment. Some pouches contain stretch material on the outer panel for positive containment of equipment. Such pouches have multiple openings for equipment insertion. Some of the pouches optionally contain preformed pockets and/or multiple pockets for the insertion of equipment. The pouches are intended to be installed, removed or positioned relative to the equipment selected to accomplish the task.

Throughout this specification, various materials are referred to specifically. For example, NEOPRENE is given as an example of a soft material suitable for parts of the present invention that will be closest to the body of an individual wearing the inventive organizer. It is appreciated that any of various soft breathable materials may be used, either synthetic such as a foam rubber or natural such as a flocked fabric layer, a felt, lambs wool or soft leather such as suede, or a mixture thereof such as a fabric/foam laminate. Where a material is referred to as a non-absorbent durable type of material such as CORDURA®, it is appreciated that any of various natural or synthetic materials may be used illustratively including heavy, coarse, closely woven canvas fabric of a natural fiber such as cotton, hemp, or flax; leather; heavy duty nylon; vinyl; Dermizax®; Kevlar® fabric; 3 or 4 ply Supplex®; Waxide®; Sharkskin® and heavy duty synthetic leathers such as those made of polyurethane or the like. It is further appreciated that where additional non-absorbing properties are desirable, a material is treated with materials such as silicone elastomers and the like according to methods known in the art to provide waterproofing.

Although a removable clear cover is discussed herein as being made of vinyl, it is appreciated that a transparent or translucent cover is made from any of various flexible materials illustratively including acrylic, cellulose, polyamides such as Nylon 6 and Nylon 6, 6, polycarbonate, polyethylene, polystyrene, or other material that allows the pockets of the organizer to be visible under the cover.

Some pouches are referred to herein as containing stretch material on the outer panel for positive containment of equipment. Suitable stretch materials illustratively include spandex, supplex and the like.

FIG. 1 shows the main unit 10 for the system. The main unit 10 has a neckline 12 cut for comfort, and rounded edges. The inner panel 3 is made of a soft breathable material for added comfort. The outer panel is made of a tough non-absorbent, durable material. Separating the two, the middle panel is made of a hard dense material (plastic) for added support of whole unit. Fasteners 1 and 14 are located for the attachment of the adjustable neck strap. Fasteners 4 and 16 are located for the attachment of the removable shelf adjustable straps. Fasteners 5 and 18 are located for the attachment of the adjustable waist belt. VELCRO® strips, shown at 2 and 19, are attached at even locations to the front of the unit. The VELCRO® strips are placed in any convenient orientation for attachment of various pouches and the removable shelf. This is for locating the pouches and removable shelf as required. In a preferred embodiment, as shown in FIG. 1, a VELCRO strip is oriented horizontally for attachment of the removable shelf. Alternatively, the removable shelf is attached at multiple points to vertically oriented strips 19. Although VELCRO strips for attachment of pouches, clear covers and a removable shelf, are referred to in the drawings as having a specific orientation, it is appreciated that any orientation of the strips that is operable for attachment of desired pouches, clear covers and a removable shelf is within the scope of the contemplated invention.

FIG. 2 shows a basic pouch design 20 having three variable depth pockets 22, 24 and 26. The pouch is made of tough non-absorbent material, with VELCRO® strips 27 and 28 located on the aft side for attachment to the main unit 10. VELCRO® 25 is provided for attachment of the clear vinyl cover 29 to protect the tool and prevent loss. This cover 29 is completely removable.

Figure 3B:
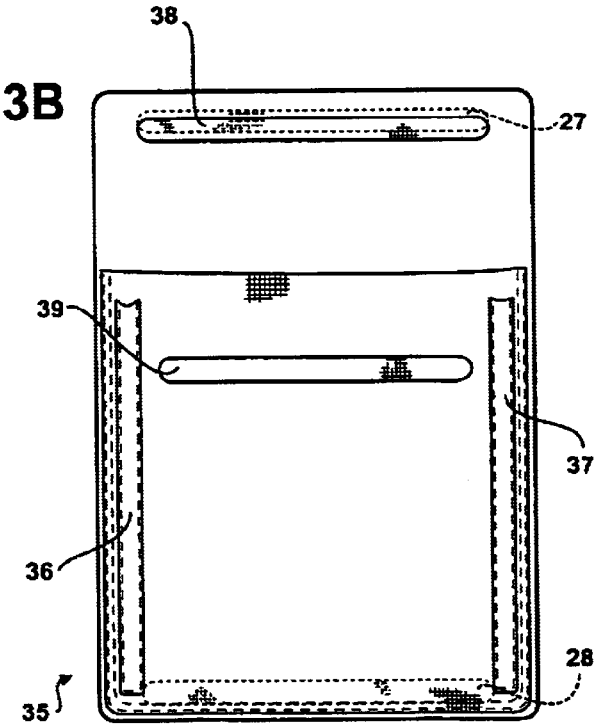
Figure 3C:
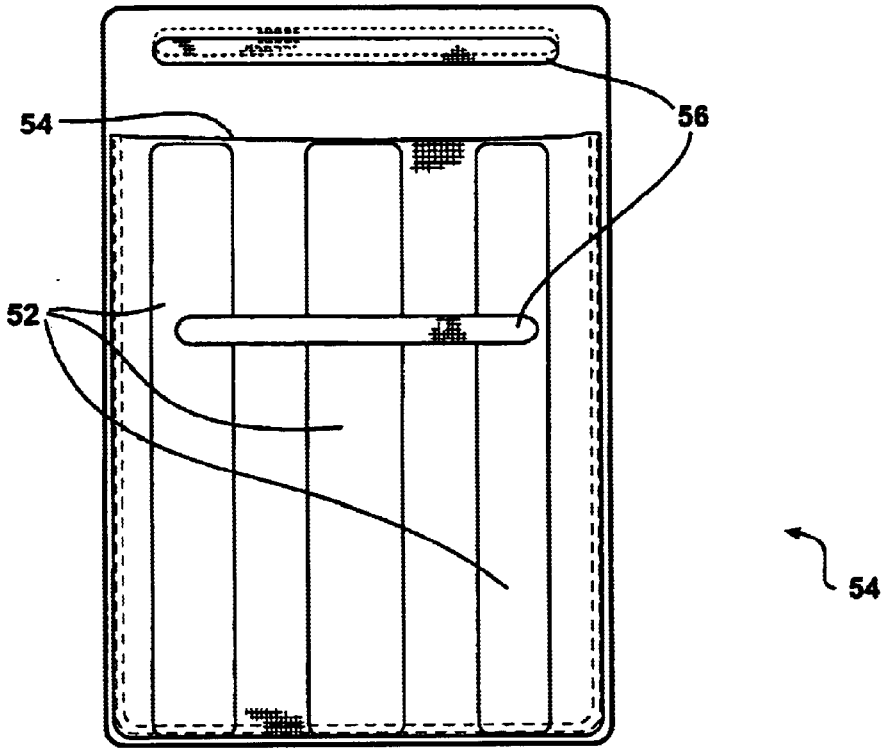

FIG. 3A shows a pouch is a single pocket design 30, with a single VELCRO® strip at the top 32 and middle 33 for attachment of a pocket slot 31 and clear cover (not shown). FIG. 3B shows a pouch 35 adapted to receive a digital multimeter. Two separate probe slots 36 and 37 are provided, and also include the VELCRO® strips 38 and 39 for attaching the clear plastic cover (not shown). FIG. 3C shows a pouch 50 with stretch type material 52 utilized for secure tool holding of the present invention. A pouch 50 is optionally multiple slotted or single slotted 54 depending on tool design. The depth and width vary as required. The pouch 50 has VELCRO® strips 56 for the clear plastic cover.

Figure 4:
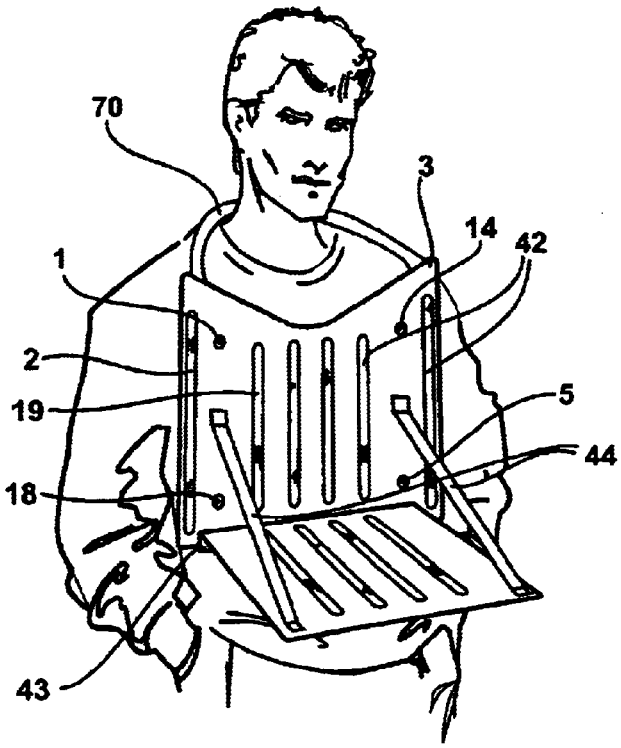
FIG. 4 is a perspective view of a shelf attached to the main component of FIG. 1.

FIG. 4 shows a detachable folding shelf unit of the present invention. The inner and outer panels are made of a tough non-absorbent fabric, and the middle panel is made of a hard dense material (plastic) for support. The unit has VELCRO® strips 42 attached to one side for installation of the pouches if required. The flip down tab 43 is for attaching to the main unit, in addition to the two adjustable straps 44. The adjustable straps 44 allow for the shelf to be infinitely adjustable when in the standing position.

Figure 5:
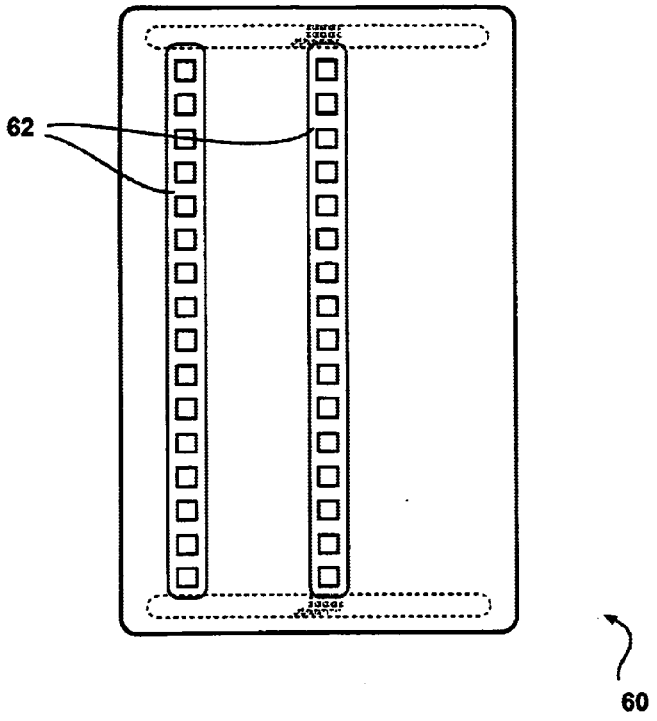

FIG. 5 shows a socket strip pouch 60 of the present invention. The unit has socket strips 62 sewn into the material for ease of access. This unit optionally has a clear plastic cover.

Figure 6A:
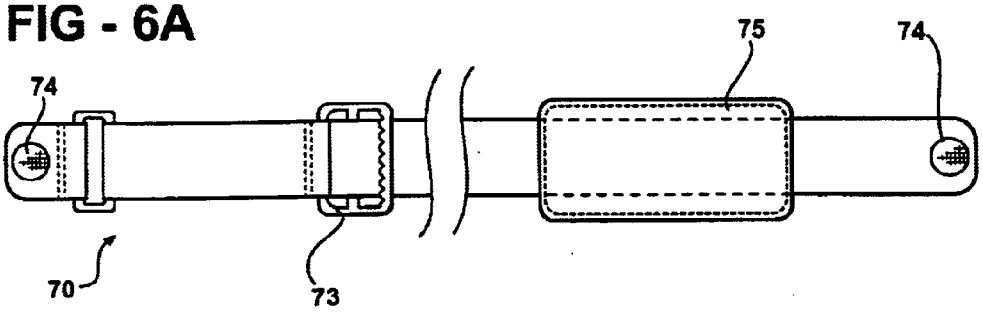
FIG. 6A is a front view of the neck utilized with the main unit of FIG. 1.
Figure 6B:
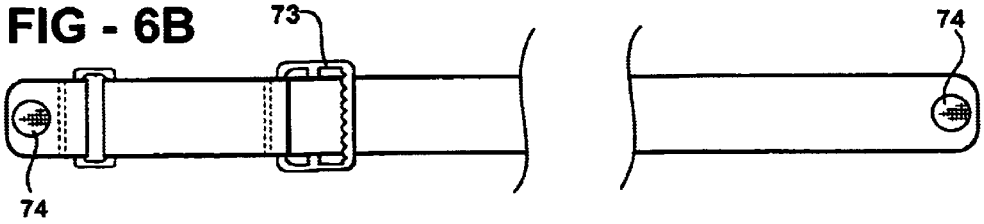
FIG. 6B is a front view of the waist strap utilized with the main unit of FIG. 1.

FIGS. 6A and 6B show a neck strap 70 and waist strap 72 respectively required for the main unit 10 of the present invention as shown in FIG. 1. The buckles 73 allow the straps to be infinitely adjustable. The fasteners 74 are for attaching to the main unit. The neck strap contains a strip of soft material 75 for comfortable contact with the skin.

What is claimed is:

1. A tool chest organizer comprising:

a main unit having a skin compatible surface and an opposing surface;

a first plurality of hook and loop fastener strips attached to the opposing surface;

a plurality of snap fastener portions attached to the opposing surface;

a detachable pocket having a hook and loop fastener strip complementary to one of said first plurality of hook and loop fastener strips attached to the opposing surface;

a neck strap adjustably attached to said main unit;

a waist strap adjustably attached to said main unit;

an attachable shelf unit having a snap fastener component and a plurality of hook and loop fastener strips on a work surface thereof, said shelf unit attached horizontally to said main unit by a complementary hook and loop fastener strip to one of said first plurality of hook and loop fastener strips on the opposing surface of said main unit; and a support strap securing the snap fastener component of said shelf unit to said main unit.

2. The organizer of claim 1 further comprising an attachable translucent cover, said cover attached to said main unit by a complementary hook and loop fastener strip to one of said first plurality of hook and loop fastener strips on the opposing surface of said main unit.

3. The organizer of claim 1 further comprising an adjustable buckle for adjustment of the support strap.

4. The organizer of claim 1 further comprising a reflective material attached to the main unit.

5. The organizer of claim 1 further wherein a detachable pocket comprises a stretch material outer panel.

6. The organizer of claim 1 further wherein a detachable pocket comprises at least two preformed compartments.

7. A tool chest organizer comprising:

a main unit having a skin compatible surface and an opposing surface;

a first plurality of hook and loop fastener strips attached to the opposing surface;

a plurality of snap fastener portions attached to the opposing surface;

a detachable pocket having a hook and loop fastener strip complementary to one of said first plurality of hook and loop fastener strips attached to the opposing surface;

a neck strap adjustably attached to said main unit;

a waist strap adjustably attached to said main unit;

a hinged attachable shelf unit having an attachment face, a work surface, a snap fastener component and a plurality of hook and loop fastener strips, the fastener strips on the attachment face and on the work surface thereof, said shelf unit attached horizontally to said main unit by a complementary hook and loop fastener strip to one of said first plurality of hook and loop fastener strips on the opposing surface of said main unit; and a support strap securing the snap fastener component of said shelf unit to said main unit.

8. The organizer of claim 7 further comprising an attachable translucent cover, said cover attached to said main unit by a complementary hook and loop fastener strip to one of said first plurality of hook and loop fastener strips on the opposing surface of said main unit.

9. The organizer of claim 7 further comprising an adjustable buckle for adjustment of the support strap.

10. The organizer of claim 7 further comprising a reflective material attached to the main unit.

11. The organizer of claim 7 further wherein a detachable pocket comprises a stretch material outer panel.

12. The organizer of claim 7 further wherein a detachable pocket comprises at least two preformed compartments.

* * * * *

UNITED STATES PATENT AND TRADEMARK OFFICE

CERTIFICATE OF CORRECTION

PATENT NO. : 6,729,520 B2
DATED : May 4, 2004
INVENTOR(S) : Jeffrey Gilbert

It is certified that error appears in the above-identified patent and that said Letters Patent is hereby corrected as shown below:

Column 2,
Lines 45-46, delete "Fig. 4A is a front view of an attachable shelf according to the present"

Signed and Sealed this

First Day of February, 2005

JON W. DUDAS
*Director of the United States Patent and Trademark Office*